United States Patent [19]

Nakanishi

[11] 4,010,057

[45] Mar. 1, 1977

[54] PRINTING APPARATUS

[75] Inventor: Motoyasu Nakanishi, Isezakishi, Japan

[73] Assignee: Kabushiki Kaisha Kobayashi, Isezakishi, Japan

[22] Filed: July 11, 1975

[21] Appl. No.: 595,305

[30] Foreign Application Priority Data

Aug. 12, 1974 Japan ..... 49-92127
Dec. 26, 1974 Japan ..... 50-148426

[52] U.S. Cl. ..... 156/384; 156/230; 156/236; 156/285; 156/540; 156/542; 156/584

[51] Int. Cl.[2] ..... B44C 1/16

[58] Field of Search ..... 156/540, 541–542, 156/230, 235, 236, 238, 246, DIG. 37, 212, 83, 277, 285, 384, 475; 427/280, 430

[56] References Cited

UNITED STATES PATENTS

| | | | |
|---|---|---|---|
| 618,672 | 1/1899 | Henry | 427/280 |
| 2,489,987 | 11/1949 | Barnola | 156/235 |
| 2,817,225 | 12/1957 | Weglin | 427/280 |
| 2,981,632 | 4/1961 | Bennett | 427/280 |
| 3,554,834 | 1/1971 | Bennett et al. | 156/230 |
| 3,933,561 | 1/1976 | Larson et al. | 156/246 |

*Primary Examiner*—Charles E. Van Horn
*Assistant Examiner*—Michael W. Ball

[57] ABSTRACT

A printing apparatus wherein a thin film on which a pattern is printed is floated on the surface of liquid and the pattern is transferred onto a surface of an object to be printed with the pattern utilizing the liquid pressure by submerging the object into the liquid while pressing the object onto the thin film.

26 Claims, 9 Drawing Figures

PRINTING APPARATUS

BACKGROUND OF THE INVENTION

The present invention relates to a printing apparatus which prints patterns such as wood grain patterns and other patterns onto molded synthetic resin products such as a cabinet of a television set, a casing of a vacuum cleaner or metallic products such as aluminum sashes, etc.

Conventionally, an apparatus which prints a wood grain pattern onto a surface of a plain product by an impression plate of wood grain pattern made from a phototype has been known as a wood grain pattern printing apparatus to print on various types of products. This apparatus permits printing only on flat surfaces and cannot therefore print on curved, protruding, concave or recessed surfaces.

In addition to the above, an apparatus which transfers a wood grain pattern which is provided on a plate cylinder by means of a phototype onto a soft polyurethane roll and prints said wood grain pattern from said polyurethane cylinder onto the surface of a product is also known to be useful for the same purpose. This apparatus permits printing on curved surfaces with a large curvature but has difficulties in printing on greatly uneven surfaces or surfaces having recessed parts with small diameters.

On the other hand, an apparatus which transfers an irregular stripe pattern, prepared by dropping a printing ink on a water surface, onto a product surface by submerging the product into the water has also been known. This apparatus is disadvantageous in that it takes a long time to form a pretty stripe pattern on the water surface, it is impossible to make the same stripe pattern each time, resulting in different patterns being printed on different products and a stripe pattern transferred onto a product surface greatly differs from an actual wood grain pattern.

Furthermore, a method of molding products by mixing a plurality of types of synthetic resins of different colors and brightness has been developed as a method to form wood grain patterns. This method is also disadvantageous in that the pattern will differ with different products, a desired pattern will not be obtained and this method cannot be applied to those products other than plastic objects such as synthetic resins.

The present invention is intended to resolve the problems described above and to provide a printing apparatus capable of printing on the surfaces of objects with curved parts, projections, concavities and convexities.

The present invention provides a printing apparatus which is capable of printing the same pattern on all products.

Moreover, the present invention provides a printing apparatus which is capable of printing wood grain patterns resembling actual wood grains in a relatively short period of time.

By the printing apparatus according to the present invention, it is possible to print in colors on objects with uneven surfaces.

SUMMARY

An apparatus in accordance with the present invention comprises a printing means, for example, an intaglio printing means, which prints a pattern such as a wood grain pattern on a thin film made of starch or the similar like with a printing ink; a transferring means which is provided with a basin which is formed to store a liquid such as, for example, water and to have a space above the surface of said liquid whereby a thin film onto which a pattern is printed by said printing means is floated on the surface of said liquid so that its pattern-printed surface is face up and said pattern is transferred onto the surface of said object by the pressure of said liquid by submerging at least a part of said object into the liquid while said object is kept in contact with the pattern-printed surface of said thin film; and a thin film removing means which removes said thin film from the object to which said pattern is transferred, for example, a decomposing means which decomposes said farinaceous thin film in a solution containing a starch decomposing enzyme in which said object is submerged.

BRIEF DESCRIPTION OF THE DRAWINGS

The present invention is illustrated in detail by the accompanying drawings wherein.

DETAILED DESCRIPTION OF THE INVENTION

Figure 1:
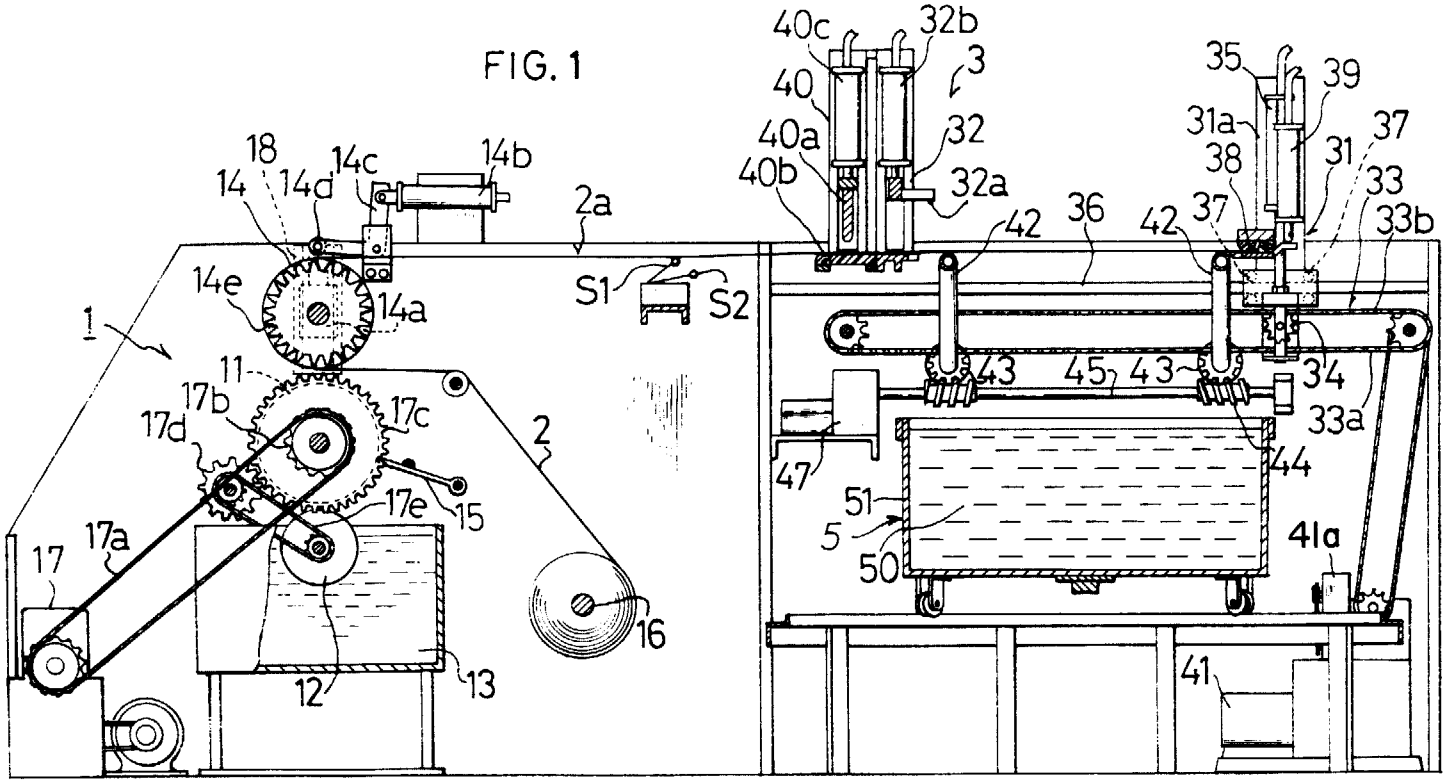
FIG. 1 is a cross sectional view showing the printing means in the apparatus in accordance with the present invention and a part of the basin in which the thin film is to be floated.

Referring to FIG. 1, there is shown a printing device 1 which prints a pattern such as, for example, wood grain pattern on the thin film 2 and a cutting device 3 which cuts the thin film 2, which is printed by said printing device, in a specified length.

Said printing device comprises a plate cylinder 11 which is provided with a pattern such as a wood grain pattern prepared by a phototype on the external periphery an inking roller 12 which rotates in contact with the plate cylinder to supply the ink to plate cylinder 11, ink reservoir 13 which supplies the ink to inking roller 12, impression cylinder 14 which contacts plate cylinder 11 and presses thin film 2 onto plate cylinder 11 to print the pattern on thin film 2 and doctor 15 which removes a surplus of the ink applied to the surface of said plate cylinder 11.

Said ink can be selected in accordance with the type of the object and the thin film to be printed and, in addition to so-called printing inks, paints and pigments can also be used.

Said impression cylinder is made of a soft and elastic material such as, for example, polyurethane so that thin film 2 is depressed uniformly onto plate cylinder 11.

Thin film 2 is wound in the form of a roll, held by holding roller 16, is unwound from holding roller 16 and fed between plate cylinder 11 and impression cylinder 14.

Plate cylinder 11 is coupled to a driving mechanism 17 through chain 17*a* and sprocket 17*b* so that it is rotated by said driving mechanism which includes a motor and gears and inking roller 12 is connected to plate cylinder 11 through gear 17*c*, intermediate gear 17*d* and chain 17*e* so that it will be rotated in contact with plate cylinder 11. Impression cylinder 14 is provided with bearing 14*a* which is slidably mounted on frame 18 so that impression cylinder 14 moves between the position where it comes in contact with plate cylinder 11 and the position where it does not come in contact with plate cylinder 11, and said bearing 14*a* is depressed by depression roller 14*d* at the extreme end of lever 14*c* so that it is lifted and lowered by said lever 14*c* which is lever-actuated by liquid pressure cylinder 14*b*. Impression cylinder 14 is provided with gear 14*e* which meshes with gear 17*c* of plate cylinder 11 so that it is rotated by said plate cylinder when it comes in contact with the plate cylinder.

When impression cylinder 14 is forced to contact plate cylinder 11 and to rotate by operation of liquid pressure cylinder 14*b*, thin film 2 is unwound from holding roller 16, printed between plate cylinder 11 and impression cylinder 14 and fed to cutting device 3 with the printed surface 2*a* face up. Cutting device 3 is used to cut thin film 2 in the specified length and comprises film seizing slide 31 which seizes the end of thin film 2 and travels a distance corresponding to the length as specified in the direction away from said impression cylinder 14 to feed said thin film a length as long as specified, cutting section 32 which burns off or melts by heat said thin film 2 which is fed by said film seizing slide 31 and seizing section 40 which seizes thin film 2 when it is cut.

Said cutting section 32 comprises resistance heat generating wire 32*a* such as a nichrome wire which is opposed to one side of said thin film 2 and operating cylinder 32*b* which lowers said resistance heat generating wire to bring it into contact with one side surface of said thin film 2 when the thin film is cut.

Said film seizing slide 31 is reciprocated by chains 33 positioned on both sides of the slide in a direction toward and away from cutting section 32 and comprises sprocket 34 which is mounted on frame 31*a* of slide 31 so that said sprocket can move vertically and cannot rotate, lifting cylinder 35 which lifts and lowers said sprocket to engage sprocket 34 with said chain, rotatable guide rollers 37 which are guided along guide frame 36, comb-shaped grip 38 which can seize the extreme end of thin film 2 and liquid pressure cylinders 39 which actuates said grip.

Sprocket 34 meshes with lower part 33*a* of chain 33 when it is lowered and meshes with upper part 33*b* of chain 33 when it is lifted. Accordingly, the traveling direction of slide 31 is reversed when the sprocket is lifted or lowered.

Seizing section 40 is provided at a position slightly nearer printing device 1 than the position of cutting section 32 and comprises gripping pieces 40*a* and 40*b* opposing the upper and lower surfaces of thin film 2, respectively and operating cylinder 40*c* which lowers gripping piece 40*a* against the upper side of the thin film when said thin film is cut. Accordingly, thin film 2 is held between the two gripping pieces 40*a* and 40*b* when said thin film is cut and the thin film can be easily cut.

It is preferable to use a wet-expansible material such as, for example, a film which principally contains starch as said thin film as described in the following. In this case, the thin film has small mechanical tensile strength and expands or shrinks with variation of the temperature or humidity. Accordingly, it is preferable to move said slide 31 with thin film 2 which is not tautened, but rather is slackened. For example, as shown in FIG. 1, a pair of microswitches S1 and S2 which function when said thin film comes in contact with the microswitches are arranged at a certain vertical distance below the lower surface of thin film 2 between said printing device 10 and the cutting device, and driving mechanism 41 which drives said chain 33 is provided with a speed control mechanism 41*a* which varies the running speed of the chain, in other words, the speed of the slide.

Said speed control mechanism 41*a* is adapted to vary the running speed of the chain in three steps, for example, regular, high and low speeds, and to be changed over to the regular speed when upper microswitch S1 is functioning and lower microswitch S2 is not functioning, to the low speed when the amount of slack in the thin film 2 is decreased and upper microswitch S1 does not therefore function and to the high speed when the amount of slack in the thin film 2 is increased and lower microswitch S2 functions.

With this construction, thin film 2 is kept slightly slackened since it is positioned between the upper and lower microswitches.

When impression cylinder 14 rotates in contact with plate cylinder 11, sprocket 34 engages with part 33*a* of chain 33 and slide 31 travels to the right in the drawing as grip 38 seizes the extreme end of thin film 2. When the slide reaches the specified position, impression cylinder 14 of the printing device separates from plate cylinder 11 upon a signal from a microswitch, which is not shown, to cause the printing to stop, sprocket 34 of the slide is disengaged from chain 33 to stop slide 31, seizing section 40 operates to seize thin film 2 and resistance heat generating wire 32*a* of cutting section 32 is lowered to cut thin film 2. After this, resistance heat generating wire 32*a* rises, grip 38 releases thin film 2 and thin film 2 is moved to a certain other place by other means such as, for example, a manual operation. When sprocket 34 engages with the upper part 33*b* of said chain 33, slide 31 is returned to the left in the drawing and grip 38 seizes the extreme end of thin film 2 beneath wire 32*a*.

The means to print on the thin film are not limited to the embodiment described above; for example, the means can be such that it permits printing on the thin film which is cut in advance into the specified length or that the thin film on which a pattern is continuously printed can be fed continuously to the transferring device without cutting.

In the present embodiment, thin film 2 is fed to transferring device 5 after it has been cut in the specified length by cutting device 3.

Transferring device 5 comprises basin 51 which is open at the top and stores liquid 50 such as water or acid or alkaline solution.

Said thin film 2 with the printed surface face up is floated on liquid 50 in basin 51. The operation of transferring the fiber from said cutting device 3 to the location of said thin film floating on liquid 50 can be performed manually or can be automated as shown in FIGS. 1 and 2.

Figure 2:
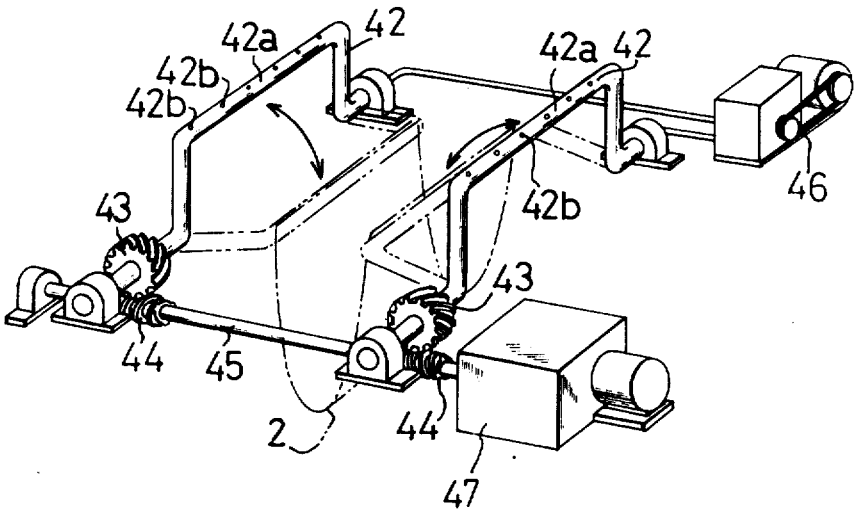
FIG. 2 is a perspective view showing a mechanism forming art of said apparatus to permit floating of a thin film on the liquid.

In FIGS. 1 and 2, a pair of bent suction pipes 42 are provided at positions below thin film 2 fed by slide 31 of cutting device 3.

A plurality of suction ports 42*b* in horizontal suction sections of suction pipes 42 are spaced along the length of horizontal suction section 42*a* which comes in contact with the lower surface of thin film 2. The suction pipes are rotated to approach or separate from each other relative to the horizontal axis and are spaced less than the specified length of said thin film 2.

Said suction pipes 42 are each provided with gears 43 at one end thereof and said gears 43 are engaged with worm gears 44. Said worm gears 44 are mounted on common shaft 45 which is rotated by driving mechanism 47 such as a motor which can rotate either in the forward direction or in the reverse direction, and said worm gears are adapted to rotate said suction pipes in the opposite directions.

Suction means 46 such as vacuum pumps or air exhaust blowers are connected to the other ends of said suction pipes.

When thin film 2 is fed to the cutting position by slide 31, suction pipes 42 are positioned at their highest positions so that their suction ports 42*b* oppose the lower surface of thin film 2. When thin film 2 is cut and grip 38 releases thin film 2, suction means 46 operates to cause the lower surfaces of both end parts of the cut thin film 2 to be held against pipes 42 by the suction at suction ports 42*b*. When the suction pipes are rotated through the specified angle in the direction in which the suction pipes approach each other, thin film 2 is concavely curved at its central part as shown by the broken line in FIG. 2.

Basin 51 which is open at the top is provided below suction pipes 42. Accordingly, the central part of thin film 2 floats on the surface of liquid 50.

After this, suction to the suction pipes 42 is stopped and pipes 42 return to the initial position and the entire thin film 2 falls down and is floated on the surface of liquid 50.

As described above, when thin film 2 is floated on the liquid after being drooped down at the central part thereof, bubbles are prevented from remaining between said thin film 2 and the surface of said liquid 50.

When said thin film 2 is floated on the liquid while holding it at its both ends, it is desirable to droop the central part of said thin film.

Thin film 2 is preferably a wet-expansible material such as, for example, a wafer like Oblaat which contains starch as the principal ingredient. In this case, thin film 2 absorbs the liquid so as to expand or extend when it is floated on liquid 50 and therefore the wrinkles in said thin film 2 disappear immediately even though the thin film has wrinkles.

Figure 3:
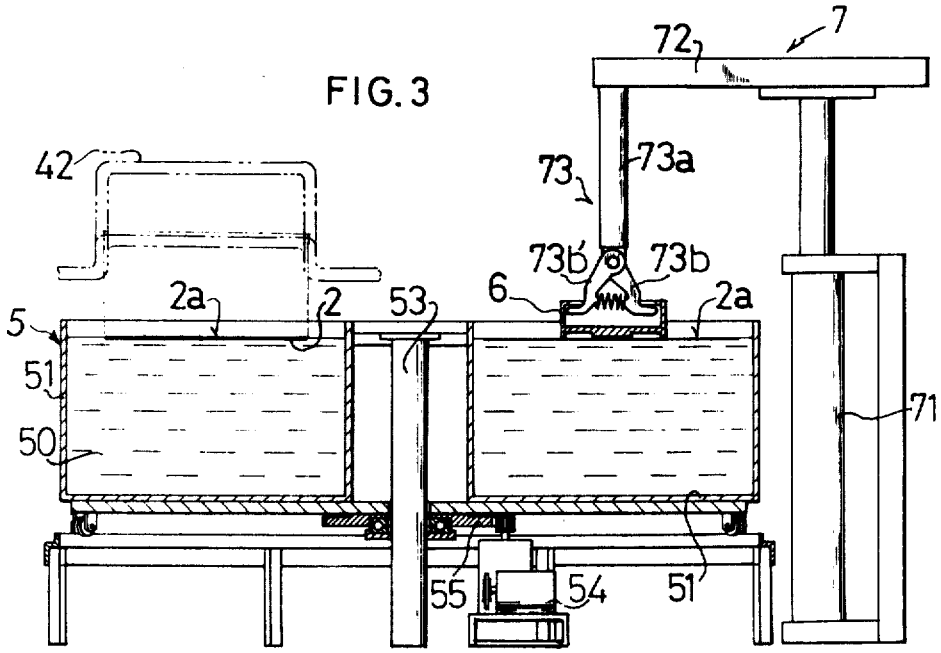
FIG. 3 is a cross sectional view showing an example of the transferring means of said apparatus.

Basin 51 containing liquid 50, as shown in FIG. 3 is moved to the position of submerging means 7 which lowers object 6 to be printed against said thin film 2 into liquid 50.

Basins 51 are radially arranged around vertical rotary shaft 53 and are moved from the position of said cutting device 3 to the position of said submerging means 7 by rotating said rotary shaft 53 by means of motor 54 and gear mechanism 55.

The means to submerge object 6 into liquid 50 can have different forms, for example, as shown in FIG. 3, the submerging means can comprise liquid pressure actuating cylinder 71 which lifts and lowers, arm 72 which projects to the side of the rod of said liquid pressure actuating cylinder 71 and holding section 73 which is suspended from the extreme end of said arm 72 as a means to hold said object 6. Holding section 73 can be freely designed in accordance with the shape of object 6; for example, it can comprise rod 73*a* which is suspended from said arm 72 and bifurcated arms 73*b* and 73*b*' provided at the lower end of said rod 73*a* so that said bifurcated arms hold object 6 by pressing onto the inside walls of the object when said object 6 is a hollow cabinet which is open on top.

Figure 4:
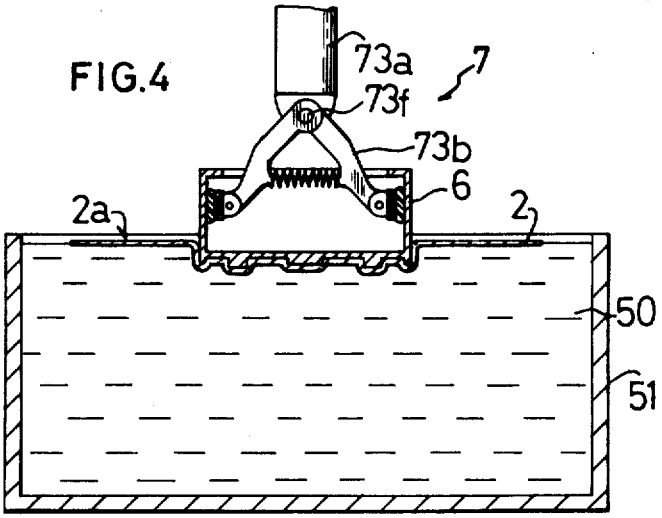
FIGS. 4 and 5 are cross sectional views illustrating the operation of said transferring means.
Figure 5:
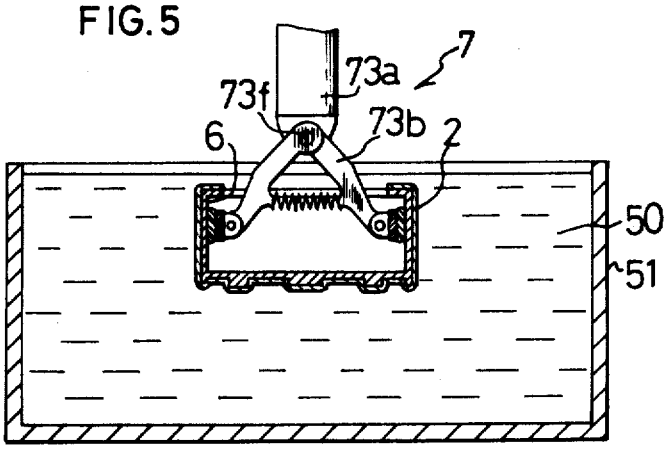

Object 6 is brought into contact with printed surface 2*a* of thin film 2, further pressed onto printed surface 2*a* of thin film 2 and submerged into the liquid 50 by said submerging means 7 as shown in FIGS. 4 and 5. Accordingly, thin film 2 closely adheres to the surface of the object and the pattern of said printed surface 2*a* of thin film is transferred onto the surface of object 6.

Submergence of the object into the liquid by said submerging means need only be enough to submerge the surface to the printed of the object into the liquid and therefore the object need not be completely submerged in the liquid.

Alternatively, object 6 can be submerged manually into the liquid.

Figure 6:
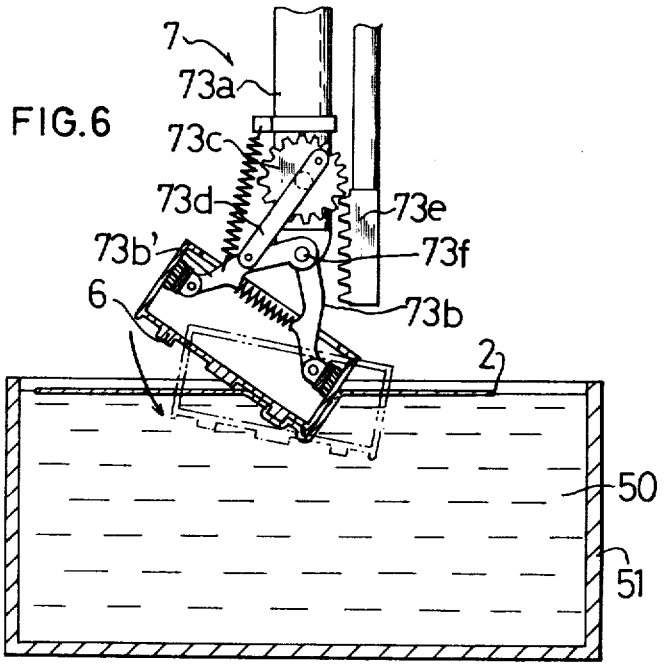
FIG. 6 is a cross sectional view of an example of said transferring means which is provided with means to vary the angle of inclination of the object to be printed.

For effective pressing of object 6 onto thin film 2 and effective close adherence of thin film to the surface of object 6, it is desirable to submerge object 6 into liquid 50 while changing the angle of object 6 with respect to the surface of liquid 50 as shown in FIG. 6. Thus, thin film 2 gradually adheres close to the surface of the object as the object is rotated and air bubbles which may remain at uneven parts of the object can be removed during the progress of gradual close adherence of said thin film. Accordingly, the means described above is especially effective for objects with projections and grooves.

In FIG. 6, gear 73*c* is provided on the body of vertical rod 73*a* which lifts and lowers, the eccentric part of said gear 73*c* and the extreme end of said bifurcated arm 73*b* are connected by connecting rod 73*d* and rack 73*e* which engages with the gear when rod 73*a* is lowered is fixed. Bifurcated arms 73*b* and 73*b*' are mounted on said rod by pins 73*f* so that they can be simultaneously rotated.

When rod 73*a* is lowered, gear 73*c* engages with rack 73*e*, thereby the gear is rotated to rotate bifurcated arms 73*b* and 73*b*' and the angle of object 6 is varied.

As described above, after the pattern printed on thin film 2 has been transferred onto object 6, thin film 2 is removed from the surface of the object by thin film removing means 8 and the printed pattern thus remains on the object surface.

Figure 7:
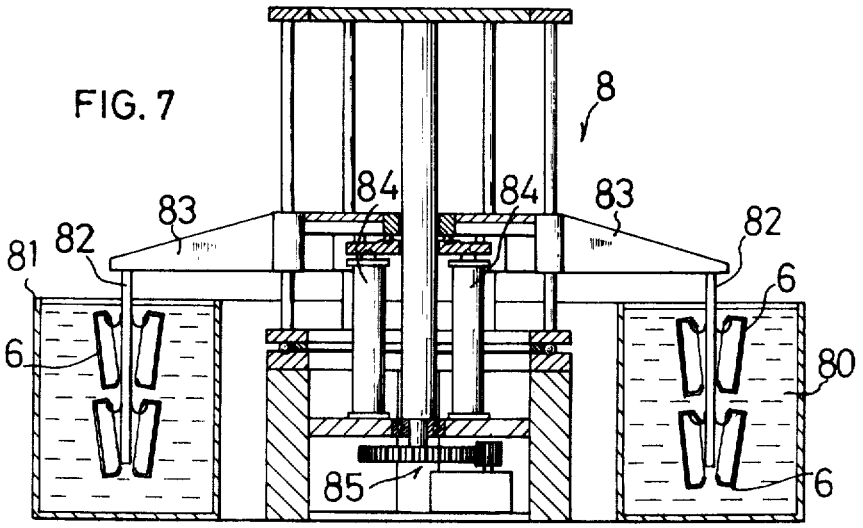
FIG. 7 is a cross sectional view of an example of the thin film removing means of the apparatus in accordance with the present invention.
Figure 8:
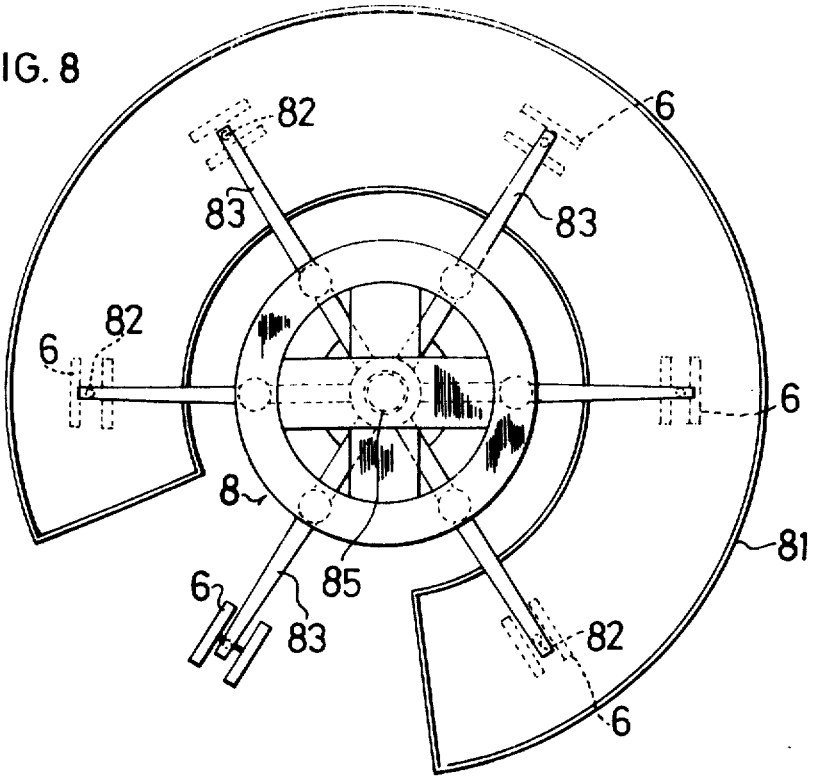
FIG. 8 is a plan view of the apparatus shown in FIG. 7.

As shown in FIGS. 7 and 8, said thin film removing means 8 comprises curved thin film removing basin 81 which contains water and is open at the top, a plurality of hangers 82 to suspend object 6, lifting cylinders 84 which lift and lower arms 83 which support said hangers 82 and driving means 85 which rotates said arms 83 along said thin film removing basin 81.

Object 6 is submerged in thin film removing basin 81 by said lifting cylinder 84 while being suspended by said hangers 82 and is drawn out of the water in thin film removing basin 81 after having been kept submerged in water for a certain period of time.

Said water contains a bacterial $\alpha$-amylase as an enzyme to decompose a farinaceous thin film and therefore said farinaceous thin film 2 is decomposed and removed by the action of said enzyme.

The temperature of said water may be from the room temperature to 70° C but it is preferably warm water at about 40° to 60° C to promote the action of said enzyme. The length of time the object is submerged in the water containing the enzyme may be approximately 1 to 20 minutes if the thickness of farinaceous thin film 2 is approximately 20$\mu$ when it is not expanded.

It is desirable to provide a stirring means (not shown) to stir the water containing the enzyme in thin film removing basin 81 and, in this case, object 6 can be submerged in thin film removing basin 81 for about 1 to 5 minutes since decomposition of said thin film 2 is promoted.

The concentration of the enzyme in the water may be 5 to 20% if the enzyme is $\alpha$-amylase and approximately 10% is most preferable.

Object 6, after being removed from said thin film removing basin 81, is washed in water in a basin which is not shown and thereby the enzyme is removed.

After washing, object 6 is preferably dried in a drying chamber which is not shown.

After this, it is preferable to apply a transparent covering material to the surface of object 6 so that the pattern printed on said object does not come off the object 6.

Where thin film 2 is made of a farinaceous material, the most desirable enzyme is $\alpha$-amylase but the enzyme can be, for example, pepsin, trypsin, erepsin, glucose, fructose, etc. depending on the material of the thin film.

Moreover, thin film removing device 8 can be adapted to dissolve thin film 2 in a liquid which does not contain the enzyme.

In this case, although said liquid can be properly selected in accordance with the material of thin film 2, warm water can be used for a water-soluble thin film and an alkaline or acid solution can be used depending on the solubility of the thin film.

Said thin film removing means can mechanically dissociate thin film 2. For example, if a fabric which is formed into a film with glue is used as thin film 2, the thin film can be dissociated by dissolving the glue in warm water or the like.

In case of dissolving or dissociating said thin film with a liquid, the liquid can be showered onto the surface of object 6. The liquid which will dissolve the thin film can be atomized and applied onto the thin film. Furthermore, where the thin film can be dissolved or separated by a special gas, the gas can be directed onto the thin film.

If thin film 2 is made of a material which is melted at high temperatures, a means to heat said thin film can be used as the thin film removing means. If thin film 2 is made of a material which is destroyed at low temperatures, a means to treat said thin film 2 at low temperature can be used. Furthermore, a means to physically exfoliate thin film 2 from the object can be used.

Remove of the thin film can be finished after completion of the transferring. Accordingly, removal of the thin film can be commenced simultaneously with commencement of transferring. For example, when a liquid which can dissolve or dissociate the thin film is used as liquid 50, transfer and removal of the thin film can be performed simultaneously.

In this case, although the thin film begins to be dissolved at the same time the transferring process starts, the transferring is performed within an extremely short period of time and there is no actual hindrance to the transfer.

If, for example, a water soluble polyvinyl alcohol is used as thin film 2, water or warm water can be used as liquid 50.

If a liquid which can dissolve the thin film is used as liquid 50, thin film removing device 8 as described in the embodiment can be provided to completely remove thin film 2 which has been removed to some extent in the transferring process.

In the above-described embodiment in which a farinaceous thin film 2 is used, if water at room temperature of approximately 20° C is used as liquid 50 in the transferring means, the farinaceous thin film 2 is slightly dissolved during the transferring process and is completely removed by thin film removing device 8. However, when the thin film removing device 8 is provided, liquid 50 need not always be such as to dissolve said thin film.

Said thin film 2 preferably has excellent expansibility when it is floated on the surface of liquid 50 and excellent flexibility to ensure complete and close adherence to uneven surfaces of the object to be printed. Particularly, if the shape of the surface of the object is complex, the thin film preferably adheres closely to the uneven surface of the object during expansion. Thus, the thin film preferably has excellent expansibility and flexibility when it is floated on liquid 50.

From this point of view, it is most preferable to use the farinaceous film as thin film 2. Use of the farinaceous thin film is more advantageous than the use of a high molecular compound film in that the former will bring about far less of a disposal problem than the latter.

In addition, the materials of the thin film can be polyacrylic acid soda, polyvinyl alcohol, methyl cellulose, carboxymethylcellulose, polyethylene oxide, polyvinylpyrolidone and acrylic acid amide as synthetic high molecular substances; glue, gelatin, casein and polypeptide from among high molecular substances; starch, cellulose, dextrin, alubmin, soy bean protein, gum arabic and tragacanth gum from among vegetable high molecular substances; and sea weed glue, Japanese gelatin and alginic acid soda among sea weed high molecular substances.

Figure 9:
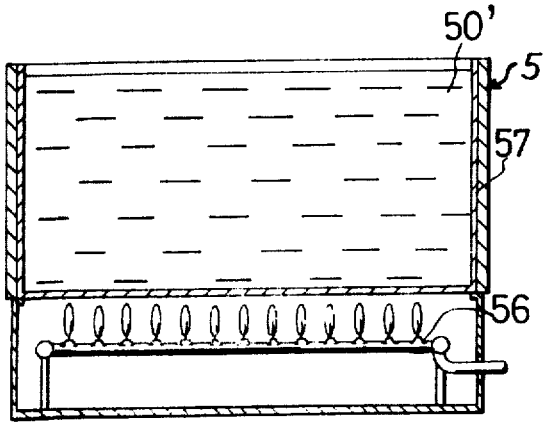
FIG. 9 is a cross sectional view showing an example of the transferring means where a liquid metal is used.

In said transferring means, a liquid metal can be used as the liquid to extend and support the thin film. In this case, transferring device 5 can comprise, for example, as shown in FIG. 9 basin 57 provided with heating means 56 such as a heater or burner wherein a molten metal with low melting temperature is stored.

Wood's alloy, Rose's alloy or Newton's alloy can be used as said liquid metal. Wood's alloy is an alloy with a melting point of 65° to 70° C and a formulation approximately that of a common compound consisting of four ingredients, Bi 50%, Pb 24 ~ 26%, Sn 12 ~ 14% and Cd 12 ~ 13%, and Rose's alloy and Newton's alloy are alloys with melting points of approximately 95° C and a formulation approximately that of a common compound consisting of three ingredients, Bi 50%, Pb 31% and Sn 19%. If the polyethylene film is used as thin film 2 it is softened and therefore the thin film adheres closely to the object 6 during transferring.

When the liquid metal is used as a film supporting means of the transferring means, it generally has a large surface tension and it is easy to float thin film 2 on the surface of the liquid metal. Since liquid metals generally have a large specific gravity, the liquid pressure to press the thin film onto the surface of the object is large and therefore the printing effect on uneven surfaces is improved. Furthermore, because the liquid metal generally has a relatively high temperature, transfer of the printing ink is promoted and a clear printout is obtained.

If the liquid metal is used as the film supporting means, the thin film removing means is provided as the process following the transferring process.

The apparatus in accordance with the present invention provides the following advantages.

Since the pattern to be printed is transferred by closely adhering the thin film onto the surface of the object by utilizing pressure of the liquid, the printing is possible on any object with curved, recessed or projecting surfaces.

Since the phototype technique can be used, realistic wood grain patterns can be printed on any object.

The same pattern can be printed on a number of objects.

The printing pattern is transferred onto the object and therefore a multi-color pattern can be printed on the object in one transfer operation.

What is claimed is:

1. A printing apparatus comprising:

a printing means for printing a pattern on a surface of a thin film;

a basin containing a liquid;

feeding means for feeding said printed thin film with the printed surface face up onto the surface of said liquid so that the thin film floats on the liquid;

means for submerging at least a part of an object, the surface of which is to be printed with said pattern into said liquid while said object is kept in contact with the upwardly facing pattern-printed surface of said thin film for transferring the pattern onto the surface of the object by the pressure of said liquid; and a thin film removing means for removing said thin film from the surface of said object on which said pattern is printed.

2. A printing apparatus in accordance with claim 1 wherein said liquid is a liquid containing water.

3. A printing apparatus in accordance with claim 2 wherein said thin film is a film which expands when it is exposed to water.

4. A printing apparatus in accordance with claim 3 wherein said thin film is a farinaceous film.

5. A printing apparatus in accordance with claim 4 wherein said thin film removing means is a starch decomposing enzyme.

6. A printing apparatus in accordance with claim 1 wherein said liquid is a liquid metal.

7. A printing apparatus in accordance with claim 6 wherein said basin includes a heating means for heating said liquid metal.

8. A printing apparatus in accordance with claim 1 wherein said thin film removing means comprises a container and a liquid therein which dissolves said thin film.

9. A printing apparatus in accordance with claim 1 wherein said thin film removing means is separate from said transferring means.

10. A printing apparatus in accordance with claim 9 wherein said liquid is a liquid which dissolves said thin film, whereby removal of said thin film is commenced when the transferring begins and is completed by said thin film removing means when the transferring ends.

11. A printing apparatus in accordance with claim 9 wherein said liquid is a liquid which does not dissolve said thin film, whereby removal of the thin film is commenced by said thin film removing means only after completion of the transfer of said pattern.

12. A printing apparatus in accordance with claim 9 wherein said thin film removing means is a means to dissolve said thin film which adheres closely to the surface of said object by submerging said object in a liquid which dissolves said thin film.

13. A printing apparatus in accordance with claim 9 wherein said thin film removing means is a means for peeling said thin film off the surface of said object.

14. A printing apparatus in accordance with claim 9 wherein said thin film removing means is a means to spray a liquid which dissolves said thin film on said object to which said thin film adheres closely.

15. A printing apparatus in accordance with claim 9 wherein said thin film removing means is a means for causing a gas containing an atomized liquid which will dissolve said thin film to act on said object to which said thin film adheres closely.

16. A printing apparatus in accordance with claim 9 wherein said thin film removing means is a means for causing a gas which decomposes said thin film to act on said object to which said thin film adheres closely.

17. A printing apparatus in accordance with claim 9 wherein said thin film removing means is a means for causing an atmosphere which has a temperature sufficiently high to melt said thin film to act on said thin film.

18. A printing apparatus in accordance with claim 9 wherein said thin-film removing means is a means for causing an atmosphere which has a temperature sufficiently high to exfoliate said thin film to act on said thin film.

19. A printing apparatus in accordance with claim 1 wherein said means for submerging comprises a means for submerging said object into said liquid while changing the angle of said object relative to the horizontal surface of said liquid.

20. A printing apparatus in accordance with claim 1 wherein said means for submerging comprises a holding means which holds said object and a lifting means which lifts and lowers said holding means, whereby said object is forced into contact with the thin film afloat on the surface of said liquid and is submerged into the liquid by movement of said lifting means.

21. A printing apparatus in accordance with claim 1 further comprising a cutting means adjacent said feeding means for cutting the printed film into predetermined lengths.

22. A printing apparatus in accordance with claim 1 wherein said feeding means comprises a film floating means for lowering a length of thin film from above the surface of said liquid in said basin and floating said thin film on the surface of the liquid.

23. A printing apparatus in accordance with claim 22 wherein said film floating means comprises a supporting means for supporting both ends of said thin film and for releasing said thin film, and said supporting means being actuated for floating the central part of said thin film on the surface of said liquid while said central part is drooped down and for releasing both ends of said thin film to float the entire thin film on the surface of the liquid.

24. A printing apparatus in accordance with claim 22 further comprising cutting means ahead of said printing means for cutting said film to predetermined lengths, and said printing means prints the lengths of thin film.

25. A printing apparatus in accordance with claim 1 wherein said printing means comprises a holding means which holds a roll of thin film, a printing mechanism which unwinds said thin film from said holding means and prints it, and a cutting means which cuts the thin film which is continuously printed by said printing mechanism into predetermined lengths.

26. A printing apparatus in accordance with claim 25 further comprising a detecting means along the path of the printed film between said cutting means and said printing mechanism and connected to said feeding means which detects a downward slackness due to the weight of said thin film and adjusts the feed rate of the thin film so that the amount of slack in said thin film is controlled within a predetermined range.

* * * * *